US008246318B2

(12) United States Patent
Tanaka et al.

(10) Patent No.: US 8,246,318 B2
(45) Date of Patent: Aug. 21, 2012

(54) WATER-COOLED AIR COMPRESSOR

(75) Inventors: Hideharu Tanaka, Shizuoka (JP); Masahiko Takano, Shizuoka (JP); Akihiro Nagasaka, Shizuoka (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 955 days.

(21) Appl. No.: 12/142,069

(22) Filed: Jun. 19, 2008

(65) Prior Publication Data

US 2008/0314562 A1 Dec. 25, 2008

(30) Foreign Application Priority Data

Jun. 19, 2007 (JP) ..... 2007-161839

(51) Int. Cl.
*F04B 39/04* (2006.01)
*F04B 39/06* (2006.01)

(52) U.S. Cl. ..... 417/228; 417/278; 417/313; 700/301; 62/505; 62/195; 62/201; 62/231; 62/303; 165/262; 165/280; 165/282; 165/286

(58) Field of Classification Search ..... 417/228, 417/278, 313; 165/262, 280, 282–286, 166, 165/101, 100; 62/231, 303, 157, 195, 201, 62/401, 501; 700/301, 306
See application file for complete search history.

(56) References Cited

U.S. PATENT DOCUMENTS 3,152,753 A * 10/1964 Adams ..... 417/53
4,635,712 A * 1/1987 Baker et al. ..... 165/82
5,082,427 A * 1/1992 Fujiwara et al. ..... 417/292
5,226,471 A * 7/1993 Stefani ..... 165/200
5,386,873 A * 2/1995 Harden et al. ..... 165/47
5,433,246 A * 7/1995 Horton ..... 137/565.12
5,603,228 A * 2/1997 Barthold et al. ..... 62/303
6,058,974 A * 5/2000 Blomgren ..... 137/625.43
6,533,552 B2 * 3/2003 Centers et al. ..... 417/12
7,044,716 B2 * 5/2006 Fabry ..... 417/243
(Continued)

FOREIGN PATENT DOCUMENTS

CN 1584334 A 2/2005
(Continued)

OTHER PUBLICATIONS

Search Report dated Feb. 4, 2011 with partial translation.
(Continued)

*Primary Examiner* — Devon C Kramer
*Assistant Examiner* — Joseph Herrmann
(74) *Attorney, Agent, or Firm* — Antonelli, Terry, Stout & Kraus, LLP.

(57) ABSTRACT

Provided is a water-cooled air compressor which is capable of restraining lowering of the performance of a plate type compressor for heat-exchanging compressed air from a compressor body, with cooling water due to clogging of gaps between plates in the heat-exchanger by dust or the like, incorporating a first solenoid valve and a second solenoid valve connected respectively in a cooling water supply pipe line and a cooling water discharge pipe line of the heat-exchanger, an air feed pipe line connecting between a compressed air supply pipe line on the outlet side of the heat-exchanger and the cooling water discharge pipe line, a third solenoid valve and a check valve connected in the air feed pipe line, a discharge pipe line connected in a discharge pipe line 18 so as to branch therefrom, a fourth solenoid valve connected in the discharge pipe line, and a control device for controlling opening and closing of the first to fourth solenoid valves.

16 Claims, 3 Drawing Sheets

U.S. PATENT DOCUMENTS

| | | | | |
|---|---|---|---|---|
| 7,172,015 | B2 * | 2/2007 | Miura et al. | 165/166 |
| 2003/0034146 | A1 * | 2/2003 | Kaufman | 165/11.1 |
| 2006/0272681 | A1 * | 12/2006 | Steinkiste | 134/22.12 |
| 2009/0324430 | A1 * | 12/2009 | Pyke et al. | 417/244 |

FOREIGN PATENT DOCUMENTS

| | | |
|---|---|---|
| JP | 2005-61402 | 3/2005 |
| JP | 2006-249934 | 9/2006 |
| WO | WO 94/11694 | 5/1994 |
| WO | WO 98/01688 | 1/1998 |

OTHER PUBLICATIONS

Office Action issued in Chinese Patent Application No. 200810125181.5 on Jan. 30, 2012.

* cited by examiner

WATER-COOLED AIR COMPRESSOR

INCORPORATION BY REFERENCE

The present application claims priority from Japanese application JP2007-161839 filed on Jun. 19, 2007, the content of which is hereby incorporated by reference into this application.

BACKGROUND OF THE INVENTION

The present invention relates to a water-cooled air compressor having a plate type heat-exchanger, and in particular to a water-cooled air compressor capable of preventing a plate type heat-exchanger from being clogged by foreign matter.

These years, there has been more and more increased the demand that air compressors are small-sized. The air compressor is mainly composed of a motor, a compressor body, a step-up gear and an incorporated dryer which occupy large spaces within the air compressor, and also includes a water-cooling type heat-exchanger which also occupies a relatively large space therein.

In view of the above-mentioned circumstance, instead of shell-and-tube type heat exchangers which have been conventionally used widely, plate type heat-exchangers which are small-sized and which have a high performance are more prosperously used as heat-exchangers for cooling compressed air in order to satisfy the above-mentioned demand (refer to, for example, JP-A-2006-249934).

SUMMARY OF THE INVENTION

The plate type heat-exchangers each of which comprises a plurality of washboard-like plates which are stacked one upon another, are roughly classified into two types, that is, a packing type in which the plates are sealed together with packing therebetween, and a brazing type in which plates are integrally incorporated with one another by brazing.

The former packing type heat-exchanger is advantageous since it can be disassembled so as to facilitate the internal cleaning thereof, but it is disadvantageous since it is expensive, so as to possibly cause a risk of leakage through the packing and so forth. Thus, the brazing type heat-exchangers are widely used at present as the plate type heat-exchangers.

The plate type heat-exchanger is small-sized and is excellent in its performance. However, gaps between plates is relatively small, that is, it is about 2 to 3 mm, and accordingly, foreign matter such as dust having entered into a water cooling system is possibly built up in the plate type heat-exchanger, the flow of cooling water is hindered, and accordingly, the performance of the heat-exchanger would be lowered so that the heat-exchanger should be frequently cleaned.

In order to prevent the clogging gaps between the plates by foreign matter such as dust, there may be carried out in general the method that a strainer is arranged on the inlet side of the water cooling system in the plate type heat-exchanger so as to separate the foreign matters such as dust from cooling water by the strainer, and thereafter, the cooling water is fed into the heat-exchanger. As stated above, the gaps between the plates in the plate type heat-exchanger is about 2 to 3 mm which is relatively smaller than diameters of tubes, which are about 6 to 20 mm, in a conventional shell-and-tube type heat-exchanger. Thus, even foreign matter such as dust contained in the cooling water, which has not yet caused any problem in the shell-and-tube type heat-exchange would cause the problem of clogging the gaps between the plates, resulting in lowering of the performance of the heat-exchanger.

In order to eliminate the above-mentioned problem, a strainer is arranged upstream of the plate type heat-exchanger so as to separate foreign matter such as dust from cooling water. However, should a strainer having an extremely fine mesh size with a high degree of accuracy for separation be used, the strainer would be clogged at an early stage. In order to avoid the clogging, the accuracy for separation has been set to a moderate value.

Thus, microscopic foreign matter such as dust, sludge or the like contained in the cooling water which is in general fed from a cooling tower may pass through the strainer, and as a result, the foreign matter clogs gaps between the plates in the plate type heat-exchanger, causing a problem of lowering the performance of the heat-exchanger.

The present invention is devised in view of the above-mentioned problems, and accordingly, an object of the present invention is to provide a water-cooled air compressor which is capable of suppressing the lowering of the performance of the heat-exchanger caused by clogging of gaps between the plates in the heat-exchange with foreign matter such as dust.

To the end, according to a first aspect of the present invention, there is provided a water-cooled air compressor incorporating a plate type heat-exchanger for heat-exchanging between compressed air from a compressor body and cooling water, characterized by the provision of a first solenoid valve and a second solenoid valve which are provided respectively in a cooling water supply pipe line and a cooling water discharge pipe line of the heat-exchanger, an air feed pipe communicating between a compressed air supply pipe line provided on the outlet side of the heat-exchanger, and the cooling water discharge pipe line, a third solenoid valve and a check valve which are provided in the air feed pipe line, a discharge pipe line which is connected the cooling water supply pipe line of the heat-exchanger so as to branch therefrom, a fourth solenoid valve provided in the discharge pipe line, and a control device for controlling the opening and closing of the first to fourth solenoid valves.

According to a second aspect of the present invention, in the first aspect of the present invention, the control device comprises a storage portion storing therein timings with which there is carried out operations of closing the first solenoid valve, closing the second solenoid valve, opening the third solenoid valve and opening the fourth solenoid valve in the mentioned order, and a computing portion for delivering opening and closing signals to the first to fourth solenoid valves with the timings stored in the storage portion, in response to a stop signal as to the compressor body.

According to a third aspect of the present invention, in the first aspect of the present invention, the control device comprises a storage portion which stores therein timings with which there is carried out operations of closing the first solenoid valve, closing the second solenoid valve, opening the third solenoid valve and opening of the fourth solenoid valve in the mentioned order, and a set operating time of the compressor body, and a computing portion for delivering opening and closing signals to the first to fourth solenoid valves in response to a stop signal as to the compressor body in the case that an operation time of the compressor body exceeds the set operation time stored in the storage portion.

Further, according to a fourth aspect of the present invention, in the first aspect of the present invention, the cooling water supply pipe line and the cooling water discharge pipe line of the heat-exchanger are provided respectively with pressure detectors, and the control device comprises a storage portion which stores therein timings with which there is carried out operations of closing the first solenoid valve, closing the second solenoid valve, opening the third solenoid valve and opening the fourth solenoid valve in the mentioned order, and a set pressure differential between the cooling water supply pipe line and the cooling water discharge pipe line, and a computing portion for computing a pressure differential from output signals from the pressure detectors, and for delivering opening and closing signals to the first to fourth solenoid valves with the timings stored in the storage portion in response to a stop signal as to the compressor body in the case that the pressure differential exceeds the set pressure differential.

According to the present invention, foreign objects such as dust which has been built up in the cooling water passages in the plate type heat-exchanger can be removed away from the cooling water passages with the use of a part of compressed air in response to a stop of the compressor, thereby it is possible to enhance the workability as to the removal of the foreign matter. As a result, the performance of the plate-type heat-exchanger can be restrained from being lowered, thereby it is possible to enhance the performance of the overall compressor.

Other objects, features and advantages of the invention will become apparent from the following description of the embodiments of the invention taken in conjunction with the accompanying drawings.

DETAILED DESCRIPTION OF PREFERRED EMBODIMENTS

Explanation will be made of a water-cooled air compressors according to the present invention in the form of preferred embodiments with reference to the accompanying drawings.

Figure 1:
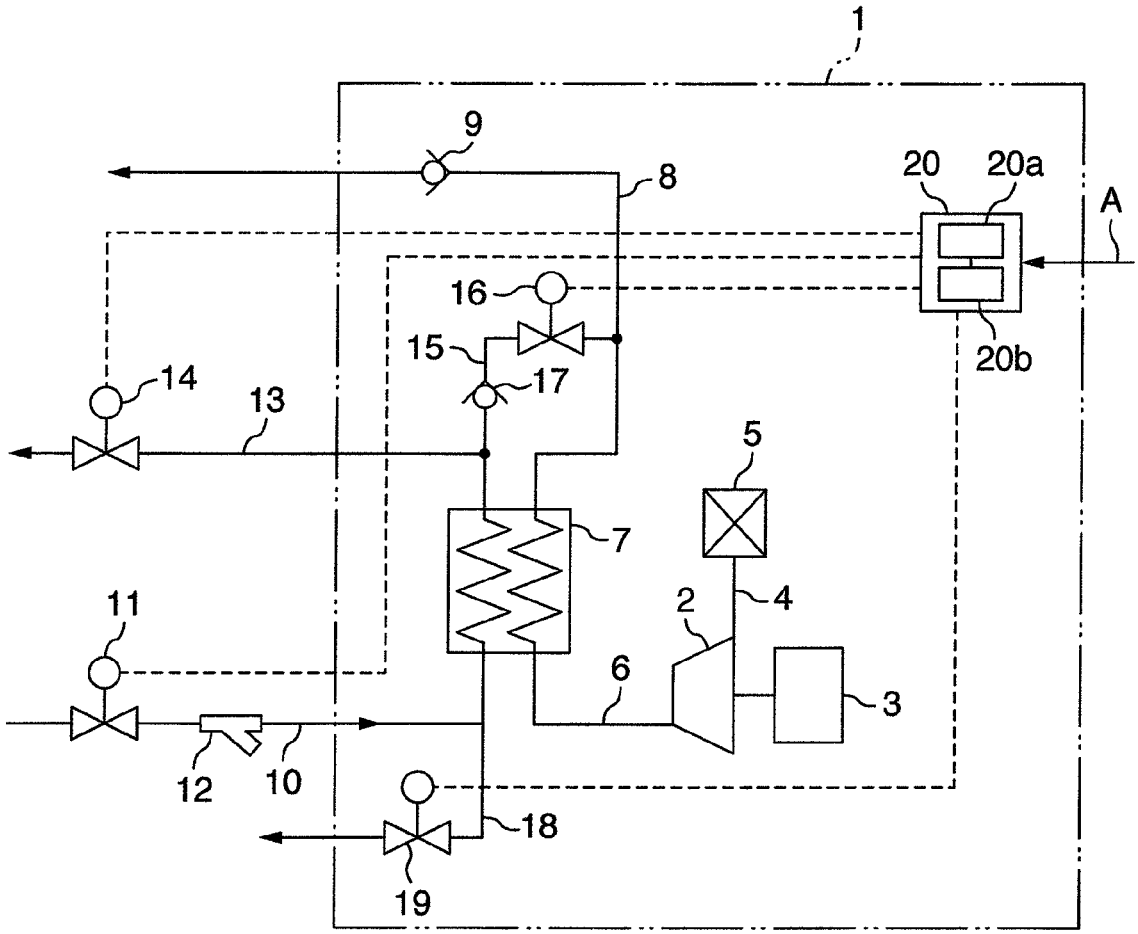
FIG. 1 is a configuration view illustrating a water-cooled air compressor in an embodiment of the present invention.
Figure 2:
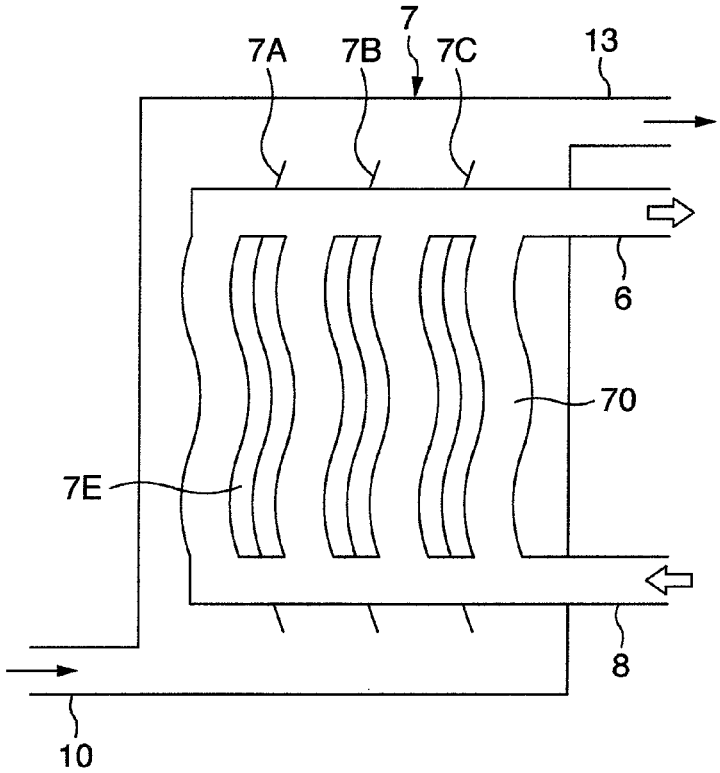
FIG. 2 is a view illustrating a configuration of a plate type heat-exchanger, as an example, which is used in the air compressor in the embodiment of the present invention.
Figure 3:
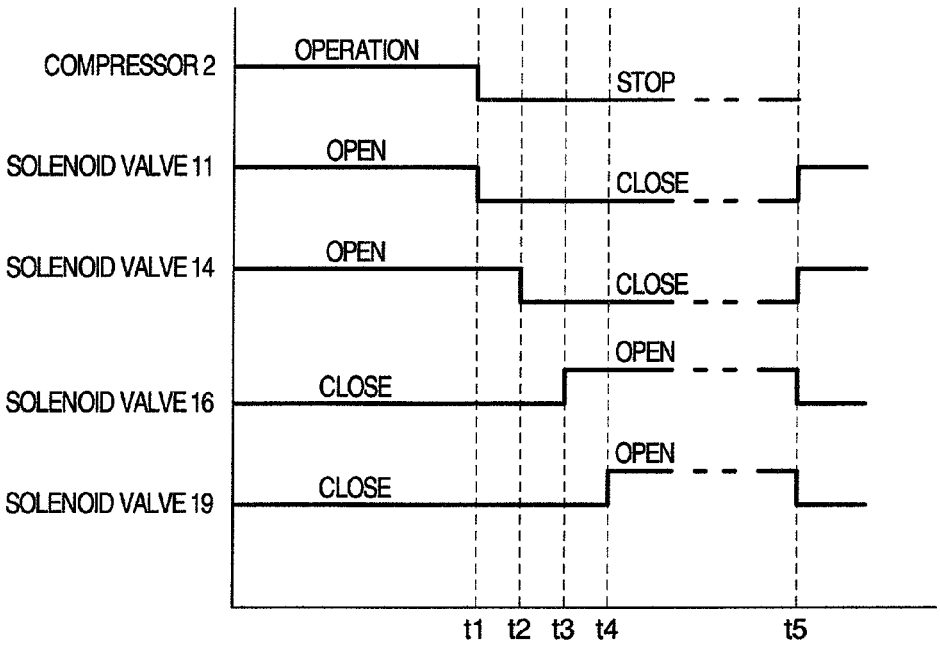
FIG. 3 is a time-chart for controlling the water-cooled air compressor according to the present invention.

FIGS. 1 and 2 show a water-cooled compressor in an embodiment of the present invention, in which FIG. 1 is a configuration view illustrating the water-cooled air compressor in the embodiment of the present invention, and FIG. 2 is a configuration of a plate type heat-exchanger, as an example, used in the water-cooled air compressor in the embodiment of the present invention, and FIG. 3 is a control time chart for the water-cooled air compressor in the embodiment of the present invention.

Referring to FIG. 1, there is shown a water-cooled air compressor unit 1 which incorporates a compressor body 2 driven by a motor 3. The compressor body 2 is connected thereto on its suction side with an air suction pipe line 4 which is provided on its suction side with a suction filter 5.

The compressor body 2 is connected on its discharge side with a compressed air inlet port of a plate type heat-exchanger 7 through the intermediary of a compressed air discharge pipe line 6. The plate type heat-exchanger 7 is connected thereto at its compressed air outlet port with a compressed air supply pipe line 8 in which a check valve 9 is provided.

The plate type heat-exchanger 7 comprises a plurality of plates 7A, 7B, 7C which are stacked one upon another, as shown in FIG. 2, so as to define therebetween compressed air passages 7D and cooling water passages 7A alternately in the stacking direction of the plates.

Referring again to FIG. 1, the water cooling passages in the plate type heat-exchanger 7 are connected on the inlet side of the cooling water passages with a cooling water pipe line 10 in which a first solenoid valve 11 and a strainer 12 are connected. The cooling water passages in the plate-type heat-exchanger 7 is connected thereto on the outlet side of the cooling water passages with a cooling water discharge pipe line 13 which is connected therein with a second solenoid valve 14.

A compressed air supply pipe line 8 on the outlet side of the plate type heat-exchanger 7 and a cooling water discharge pipe line 13 on the outlet side of the plate type heat-exchanger 7 are connected to each other through the intermediary of an air feed pipe line 15 in which a third solenoid valve 16 and a check valve 17 for preventing compressed air from counter-flowing from the cooling water discharge pipe line 13 into the compressed air supply pipe line 8 are connected being arranged in the mentioned order as viewed in the direction from the compressed air supply pipe line 8 to the cooling water discharge pipe line 13.

The cooling water supply pipe line 10 on the inlet side the plate type heat-exchanger 7 is provided with a discharge pipe line 18 which branches therefrom. The discharge pipe line 18 is connected therein with a fourth solenoid valve 19.

The first solenoid valve 11 in the cooling water supply pipe line 10, the second solenoid valve 14 in the cooling water discharge pipe line 13, the third solenoid valve 16 in the air feed pipe line 15 and the fourth solenoid valve 19 in the discharge pipe line 18, which are stated above, are controlled by a control device 20 so as to be opened and closed. The control device 20 comprises a storage portion 20*a* storing therein opening and closing timings of the first solenoid valve 11, the second solenoid valve 14, the third solenoid valve 16 and the fourth solenoid valve 19, and a computing portion 20*b* which receives the opening and closing timings stored in the storage portion 20*a* in response to a stop signal as to the compressor body 2, and which delivers opening and closing signals for the first solenoid valve 11, the second solenoid valve 14, the third solenoid valve 16 and the fourth solenoid valve 19, to the first solenoid valve 11, the second solenoid valve 14, the third solenoid valve 16 and the forth solenoid valve 19.

Explanation will be made of the opening and closing timings of the first solenoid valve 11, the second solenoid valve 14, the third solenoid valve 16 and the fourth solenoid valve 19, as an example, with reference to FIG. 3.

During the operation of the compressor body 2, the first solenoid valve 11 and the second solenoid valve 14 are opened while the third solenoid valve 16 and the fourth solenoid valve 19 are closed. In this condition, when the compressor body 2 comes to a stop, the opening and closing control is carried out as follow: the control device 20 closes at first the first solenoid valve 11 at a time t1 (corresponding to the time of stopping of the compressor body 2) in response to a stop signal A as to a compressor body 2, which is delivers from a controller (which is not shown in the Figures) for the compressor, and then closes the second solenoid valve at a time t2. Thereafter, the control device 20 opens the third solenoid valve 16 at a time t3, and then, opens the fourth solenoid valve 19 at a time t4. The control device 20 may be incorporated in the controller for the compressor.

The reason why the second solenoid valve 14 is closed at the time t2 after the first solenoid valve 11 is closed is such that the cooling water is caused to remain in the cooling water passages within the plate type heat-exchanger 7, and the residual pressure in the cooling water system is lowered as possible as it can.

Next, explanation will be made of the operation of the water-cooled air compressor in the embodiment of the present invention with reference to FIGS. 1 to 3.

Referring to FIG. 1, the compressor body 2 which is driven by the motor 3 compresses the atmospheric air which is sucked up through the suction filter 4, up to a predetermined pressure, and discharges the thus compressed air. The compressed air having a high temperature, and discharged from the compressor body 2 is heat-exchanged with the cooling water in the plate-type heat-exchanger 7, and thereafter, is discharged outside of the unit 1 by way of the check valve 9. At this time, as shown in FIG. 2, the first solenoid valve 11 and the second solenoid valve 14 are opened while the third solenoid valve 16 and the fourth solenoid valve 19 are closed.

Referring again FIG. 1, in the plate type heat-exchanger 7 which carries out heat-exchange between compressed air at a high temperature and the cooling water, the cooling water flows through the first solenoid valve 11 for opening and closing the cooling water pipe line 10 and the strainer 12 for removing foreign matter contained the cooling water, and thereafter flows into the cooling water passages in the plate type heat-exchanger 7. The cooling water is heat-exchanged with the compressed air at a high temperature within the plate type heat-exchanger 7, and thereafter, is discharged through the cooling water pipe line 13 and the fourth solenoid valve 14.

Next, when the controller (which is not shown in the Figures) for the compressor stops the operation of the compressor body 2, the control device 20 receives a stop signal A as to the compressor body 2, and as shown in FIG. 3, closes the first solenoid valve 11 at the time t1 which is the same time as that of stopping of the compressor body 2, thereafter closes the second solenoid valve 14 at the time t2 with a slight lag from the time t1 in order to causes the cooling water to remain within the cooling water passages in the plate type heat-exchanger 7. The control device 20 may be incorporated in the controller for the compressor. The reason why the second solenoid valve 12 is closed with a slight lag with respect to the first solenoid valve 11 is such that it is desirable to lower the residual pressure in the cooling water system as possible as it can.

Thereafter, in response to an instruction from the control device 20, the third solenoid valve 16 in the air feed pipe line 15 is opened at the time t3 as shown in FIG. 3, and accordingly, air is fed into the cooling water passages in the plate type heat-exchanger 7 by way of the check valve 17 with the use of the residual pressure in the compressor body 2. Next, in response to an instruction from the control device 20, the fourth solenoid valve 14 in the discharge pipe line 18 is opened at the time t4 as shown in FIG. 3. Accordingly, the cooling water which has remained in the plate type heat-exchanger 7 powerfully counterflows through the cooling water passages in the plate type heat exchanger 7, and spouts therefrom, thereby it is possible to push out foreign matters such as dust clogging the cooling water passages in the plate type heat-exchanger 7. Thereafter, the control device 20 causes the first solenoid valve 11, the second solenoid valve 14, the third solenoid valve 16 and the fourth solenoid valve 19 to return to their original open and closed positions.

In view of the above-mentioned embodiment, foreign object such as dust clogging the cooling water passages in the plate type heat-exchanger 7 can be removed and pushed away therefrom with the use of a part of the compresses air in response to a stop of the compressor, and accordingly, it is possible to enhance the removal of foreign matter. As a result, the performance of the plate type heat-exchanger 7 can be restrained from being lowered, thereby it is possible to enhance the performance of the overall compressor.

It is noted in the above-mentioned embodiment in which a part of the compressed air is fed into the cooling water passages in the plate type heat-exchanger 7 in response to a stop of the compressor in order to remove and push out foreign matter such as dust clogging the cooling water passages in the plate type heat-exchanger 7, the supply of the air into the cooling water passages in the plate type heat-exchanger 7 may be made every stop of the compressor.

It is noted, in the above-mentioned embodiment in which the control device 20 is provided in addition to the controller for the compressor itself, that the control device 20 may be incorporated in the controller for the compressor.

Further, as another embodiment of the present invention, there may be provided the configuration that the operation time of the compressor is monitored, and if the operation time exceeds a set time, the air is fed into the cooling water passages in the plate-type heat-exchanger 7. In this case, the computing portion 20*b* receives the operating time from the controller for the compressor and controls the opening and closing timings of the first solenoid valve 11, the second solenoid valve 14, the third solenoid valve 16 and the fourth solenoid valve 19 when the operation time exceeds the set time which has been stored in the storage portion 20*a* in the control device 20 in response to a stop signal as to the compressor, as shown in FIG. 3.

Figure 4:
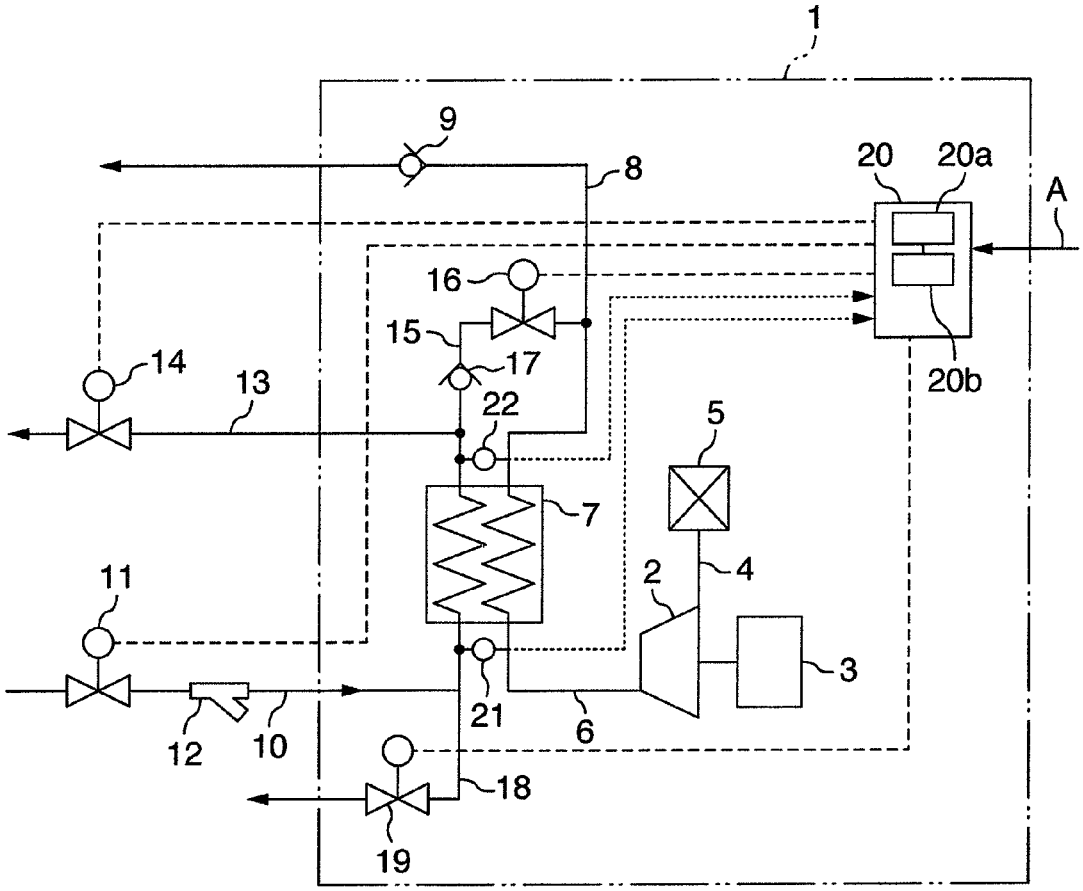
FIG. 4 is a configuration view illustrating a water-cooled air compressor in another embodiment of the present invention.

Referring to FIG. 4 which is a configuration view illustrating a water-cooled air compressor in another embodiment of the present invention and in which like reference numerals are used to denote like parts to those shown in FIG. 1 in order to abbreviate detailed description thereto, the water-cooled type air compressor in this embodiment will be explained.

In this embodiment, the cooling water supply pipe line 10 and the cooling water discharge pipe line 13 of the plate type heat-exchanger 7 are connected respectively therein with pressure detectors 21, 22, and accordingly, there may be provided the configuration that the air is fed into the cooling water passages in the heat-exchanger 7 in response to a stop as to the compressor if a difference between pressures detected by both pressure detectors 21, 22 exceeds a set value which has been previously set. In this configuration, the set value has been stored in the storage portion 20*a* of the control device 20 while the computing portion 20*b* calculates a difference between pressures detected by the pressure sensors 21, 22, and accordingly, the opening and closing timings of the first solenoid valve 11, the second solenoid valve 14, the third solenoid valve 16 and the fourth solenoid valve 19 may be controlled, as shown in FIG. 3, in response to a stop signal as to the compressor if the pressure difference exceeds the set value.

In the above-mentioned embodiment in which the cooling water supply pipe line 10 and the cooling water discharge pipe line 13 of the plate type heat-exchanger 7 are connected therein respectively with the pressure detectors 21, 22, it is noted that a pressure differential detector may be connected between the cooling water supply pipe line 10 and the cooling water discharge pipe line 13 so that a detection signal is delivered from the pressure differential detector to the control device 20. Further, the cooling water supply pipe line 10 may be connected therein with a flow detector from which a detection signal is delivered to the control device 20.

In the above-mentioned embodiments in which foreign object such as dust clogging the cooling water passages in the plate type heat-exchanger 7 can removed and pushed away therefrom with the use of a part of the compressed air in response to a stop of the compressor, it is possible to enhance the cleaning performance as to the removal of foreign object from the plate type heat-exchanger. As a result, the performance of the plate type heat-exchanger 7 can be restrained from being lowered, thereby it is possible to enhance the performance of the overall plate type heat-exchanger 7. Further, the intervals as to the cleaning of the plate type heat-exchanger 7 can be prolonged, thereby it is possible to enhance the workability and safety thereof.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A water-cooled air compressor comprising:

a compressor body configured to compress air; a water-cooled heat-exchanger configured to cool the compressed air by using cooling water; a compressed air supply pipe line configured to supply the cooled compressed air from the water-cooled heat-exchanger; a cooling water supply pipe line configured to supply the cooling water to the water-cooled heat-exchanger; an air feed pipe line configured to connect a portion of the compressed air supply pipe line provided on an outlet side of the water-cooled heat-exchanger; a first and a second cooling water discharge pipe line, wherein the first cooling water discharge pipe line is connected to the air feed pipe line, and wherein the second cooling water discharge pipe line is configured to branch from the cooling water supply pipe line; a first solenoid valve provided in the cooling water supply pipe line; a second solenoid valve provided in the first cooling water discharge pipe line; a third solenoid valve provided in the air feed pipe line; a check valve provided in the air feed pipe line; a fourth solenoid valve provided in the second cooling water discharge pipe line; and a control device configured to control a sequence of opening and/or closing of the first solenoid valve, the second solenoid valve, the third solenoid valve, and the fourth solenoid valve, thereby enabling a flow of cooling water, and in the alternative, a counterflow of cooling water, based on the sequence of opening and/or closing, wherein the control device includes:

a storage portion configured to store a preset operation time of the compressor body, and to store at least timings used in the following sequence of operations: closing the first solenoid valve, closing the second solenoid valve, opening the third solenoid valve, and opening the fourth solenoid valve, and a computing portion configured to, when an operation time of the compressor body exceeds the preset operation time, stop the compressor body and deliver a sequence of opening signals and/or closing signals to the first solenoid valve, the second solenoid valve, the third solenoid valve, and the fourth solenoid valve, thereby enabling the counterflow of cooling water used to remove foreign matter from within the water-cooled heat-exchanger.

2. The water-cooled air compressor as set forth in claim 1, wherein the control device is configured to close the second solenoid valve after a predetermined time from a closing of the first solenoid valve, so that the cooling water is caused to remain in cooling water passages in the water-cooled heat-exchanger, and residual pressure in the water-cooled heat-exchanger is lowered.

3. The water-cooled air compressor as set forth in claim 1, wherein during the preset operation time of the compressor body, the cooling water flows in a direction; wherein after the compressor body is stopped, the sequence of opening and/or closing enables the cooling water to flow in a counterflow direction, according to the control device.

4. The water-cooled air compressor as set forth in claim 1, wherein the counterflow of cooling water is pushed by the compressed air.

5. A water-cooled air compressor comprising:

a compressor body configured to compress air; a water-cooled heat-exchanger configured to cool the compressed air by using cooling water; a compressed air supply pipe line configured to supply the cooled compressed air from the water-cooled heat-exchanger; a cooling water supply pipe line configured to supply the cooling water to the water-cooled heat-exchanger; an air feed pipe line configured to connect a portion of the compressed air supply pipe line provided on an outlet side of the water-cooled heat-exchanger; a first and a second cooling water discharge pipe line, wherein the first cooling water discharge pipe line is connected to the air feed pipe line, and wherein the second cooling water discharge pipe line is configured to branch from the cooling water supply pipe line; a first solenoid valve provided in the cooling water supply pipe line; a second solenoid valve provided in the first cooling water discharge pipe line; a third solenoid valve provided in the air feed pipe line; a check valve provided in the air feed pipe line; a fourth solenoid valve provided in the second cooling water discharge pipe line; a first pressure detector connected, within the water-cooled heat-exchanger, with the cooling water supply pipe line; a second pressure detector connected, within the water-cooled heat-exchanger, with the first cooling water discharge pipe line;

a control device configured to control a sequence of opening and/or closing of the first solenoid valve, the second solenoid valve, the third solenoid valve, and the fourth solenoid valve, thereby enabling a flow of cooling water, and in the alternative, a counterflow of cooling water, based on the sequence of opening and/or closing, wherein the control device includes:

a storage portion configured to store a preset pressure differential between the cooling water supply pipeline and the first cooling water discharge pipe line, and to store at least timings used in the following sequence of operations: closing the first solenoid valve, closing the second solenoid valve, opening the third solenoid valve, and opening the fourth solenoid valve, and a computing portion configured to compute a pressure differential from output signals received from the first and second pressure detectors, and when the computed pressure differential exceeds the preset pressure differential, to stop the compressor body and deliver a sequence of opening signals and/or closing signals to the first solenoid valve, the second solenoid valve, the third solenoid valve, and the fourth solenoid valve, thereby enabling the counterflow of cooling water used to remove foreign matter from within the water cooled heat-exchanger.

6. The water-cooled air compressor as set forth in claim 5, wherein the counterflow of cooling water is pushed by the compressed air.

7. The water-cooled air compressor as set forth in claim 5, wherein the control device is configured to close the second solenoid valve after a predetermined time from a closing of the first solenoid valve, so that the cooling water is caused to remain in cooling water passages in the water-cooled heat-exchanger, and residual pressure in the water-cooled heat-exchanger is lowered.

8. The water-cooled air compressor as set forth in claim 5, wherein during an operating time of the compressor body, the cooling water flows in a direction; wherein after the compressor body is stopped, the sequence of opening and/or closing enables the cooling water to flow in a counterflow direction, according to the control device.

9. A water-cooled air compressor comprising:

a compressor means for compressing air; a water-cooled heat-exchanging means for cooling the compressed air by using cooling water; a compressed air supply means for supplying the cooled compressed air from the water-cooled heat-exchanging means; a cooling water supply means for supplying the cooling water to the water-cooled heat-exchanging means; an air feed means for connecting a portion of the compressed air supply means provided on an outlet side of the water-cooled heat-exchanging means; a first and a second cooling water discharge means, wherein said first cooling water discharge means is connected to said air feed means, and wherein said second cooling water discharge means branches from the cooling water supply means; a first solenoid valve provided in the cooling water supply means; a second solenoid valve provided in the first cooling water discharge means; a third solenoid valve provided in the air feed means; a check valve provided in the air feed means; a fourth solenoid valve provided in the second cooling water discharge means; and a control means for controlling a sequence of opening and/or closing of the first solenoid valve, the second solenoid valve, the third solenoid valve, and the fourth solenoid valve, thereby enabling a flow of cooling water, and in the alternative, a counterflow of cooling water, based on the sequence of opening and/or closing, wherein the control means includes:

a storage means for storing a preset operation time of the compressor means, and for storing at least timings used in the following sequence of operations: closing the first solenoid valve, closing the second solenoid valve, opening the third solenoid valve, and opening the fourth solenoid valve, and a computing means for, when the operation time of the compressor means exceeds the preset operation time, stopping the compressor means and delivering a sequence of opening signals and/or closing signals to the first, second, third, and fourth solenoid valve, thereby enabling the counterflow of cooling water used to remove foreign matter from within the water cooled heat exchanging means.

10. The water-cooled air compressor as set forth in claim 9, wherein the control means is for closing the second solenoid valve after a predetermined time from a closing of the first solenoid valve, so that the cooling water is caused to remain in cooling water passages in the water-cooled heat-exchanging means, and residual pressure in the water-cooled heat-exchanging means is lowered.

11. The water-cooled air compressor as set forth in claim 9, wherein the control means is also for controlling the solenoid valves after the compressor means is stopped, such that the counterflow of the cooling water during a non-operating time of the compressor means is in a direction opposite to a direction in which the cooling water flows during the operating time of the compressor means.

12. The water-cooled air compressor as set forth in claim 9, wherein the counterflow of cooling water is pushed by the compressed air.

13. A water-cooled air compressor comprising:

a compressor means for compressing air; a water-cooled heat-exchanging means for cooling the compressed air by using cooling water; a compressed air supply means for supplying the cooled compressed air from the water-cooled heat-exchanging means; a cooling water supply means for supplying the cooling water to the water-cooled heat-exchanging means; an air feed means for connecting a portion of the compressed air supply means provided on an outlet side of the water-cooled heat-exchanging means; a first and a second cooling water discharge means, wherein said first cooling water discharge means is connected to said air feed means, and wherein said second cooling water discharge means branches from the cooling water supply means; a first solenoid valve provided in the cooling water supply means; a second solenoid valve provided in the first cooling water discharge means; a third solenoid valve provided in the air feed means; a check valve provided in the air feed means; a fourth solenoid valve provided in the second cooling water discharge means; a first pressure detector connected, within the water-cooled heat-exchanging means, with the cooling water supply means; and a second pressure detector connected, within the water-cooled heat-exchanging means, with the first cooling water discharge means; and a control means for controlling a sequence of opening and/or closing of the first solenoid valve, the second solenoid valve, the third solenoid valve, and the fourth solenoid valve, thereby enabling a flow of cooling water, and in the alternative, a counterflow of cooling water, based on the sequence of opening and/or closing, wherein the control means includes:

a storage means for storing a preset pressure differential between the cooling water supply means and the first cooling water discharge means, and for storing at least timings used in the following sequence of operations: closing the first solenoid valve, closing the second solenoid valve, opening the third solenoid valve, and opening the fourth solenoid valve, and a computing means for computing a pressure differential from output signals received from the first and second pressure detectors, stopping the compressor means when the computed pressure differential exceeds the preset pressure differential, and delivering a sequence of opening signals and/or closing signals to the first solenoid valve, the second solenoid valve, the third solenoid valve, and the fourth solenoid valve, thereby enabling the counterflow of cooling water used to remove foreign matter from within the water cooled heat exchanging means.

14. The water-cooled air compressor as set forth in claim 13, wherein the counterflow of cooling water is pushed by the compressed air.

15. The water-cooled air compressor as set forth in claim 13, wherein the control means is for closing the second solenoid valve after a predetermined time from a closing of the first solenoid valve, so that the cooling water is caused to remain in cooling water passages in the water-cooled heat-exchanging means, and residual pressure in the water-cooled heat-exchanging means is lowered.

16. The water-cooled air compressor as set forth in claim 13, wherein the control means is also for controlling the solenoid valves after the compressor means is stopped, such that the counterflow of the cooling water during a non-operating time of the compressor means is in a direction opposite to a direction in which the cooling water flows during the operating time of the compressor means.

* * * * *